US010597131B2

(12) United States Patent
Peters et al.

(10) Patent No.: US 10,597,131 B2
(45) Date of Patent: Mar. 24, 2020

(54) METHOD FOR OPERATING A SHIP PROPULSION SYSTEM AND SHIP PROPULSION SYSTEM

(71) Applicant: MAN DIESEL & TURBO SE, Augsburg (DE)

(72) Inventors: Stefan Peters, Augsburg (DE); Christoph Pientschik, Kolsterlechfeld (DE); Thomas Kremser, Augsburg (DE); Kim Noergaard, Frederikshavn (DK)

(73) Assignee: MAN Energy Solutions SE, Augsburg (DE)

( * ) Notice: Subject to any disclaimer, the term of this patent is extended or adjusted under 35 U.S.C. 154(b) by 36 days.

(21) Appl. No.: 15/776,646

(22) PCT Filed: Jun. 30, 2016

(86) PCT No.: PCT/EP2016/065250
§ 371 (c)(1),
(2) Date: May 16, 2018

(87) PCT Pub. No.: WO2017/084773
PCT Pub. Date: May 26, 2017

(65) Prior Publication Data

US 2018/0327068 A1 Nov. 15, 2018

(30) Foreign Application Priority Data

Nov. 17, 2015 (DE) ..... 10 2015 014 857

(51) Int. Cl.
*B63H 21/21* (2006.01)
*B63H 3/10* (2006.01)
(Continued)

(52) U.S. Cl.
CPC ..... *B63H 21/21* (2013.01); *B63H 3/10* (2013.01); *B63H 21/14* (2013.01); *B63H 23/02* (2013.01);
(Continued)

(58) Field of Classification Search
CPC ..... B63H 21/21; B63H 3/10; B63H 21/04; B63H 23/02; F02D 29/02
(Continued)

(56) References Cited

U.S. PATENT DOCUMENTS

2010/0274420 A1* 10/2010 Veit ..... B63H 3/10 701/21
2018/0327052 A1* 11/2018 Van Miert ..... G05B 23/024
2018/0355807 A9* 12/2018 Hirose ..... F02D 41/0007

FOREIGN PATENT DOCUMENTS

CN 102458979 5/2012
JP S57 90291 6/1982
(Continued)

OTHER PUBLICATIONS

Office Action dated Jun. 17, 2019 in Japanese Patent Application No. 2018-544402.
(Continued)

*Primary Examiner* — Yazan A Soofi
(74) *Attorney, Agent, or Firm* — Cozen O'Connor

(57) ABSTRACT

A method for operating a ship propulsion system. A setpoint rotational speed is determined for a propeller shaft and a setpoint pitch angle for an adjustable propeller on a control side based on an adjustable propeller characteristic diagram and an operator. An engine is determined based on a ship's engine characteristic diagram and the setpoint rotational speed for the propeller shaft. An actual engine operating point is determined as a function of a measured actual rotational speed and a measured actual torque, so that when
(Continued)

the drive power is constant, the set-point rotational speed for the propeller shaft and the pitch angle for the adjustable propeller can be varied while reducing fuel consumption of the ship's engine and, when this is possible, the setpoint rotational speed for the propeller shaft, the setpoint pitch angle for the adjustable propeller and the setpoint operating point of the ship's engine are adapted.

6 Claims, 1 Drawing Sheet

(51) Int. Cl.
*B63H 21/14* (2006.01)
*B63H 23/02* (2006.01)
*F02D 29/02* (2006.01)

(52) U.S. Cl.
CPC ..... *F02D 29/02* (2013.01); *B63H 2021/216* (2013.01); *F02D 2200/101* (2013.01); *F02D 2200/1002* (2013.01)

(58) Field of Classification Search
USPC ..... 701/21
See application file for complete search history.

(56) References Cited

FOREIGN PATENT DOCUMENTS

| | | |
|---|---|---|
| JP | S58 63592 | 4/1983 |
| JP | 59-196927 | 11/1984 |
| JP | 08-150999 | 6/1996 |
| JP | 2012-030704 | 2/2012 |
| JP | 2013 006531 | 1/2013 |
| KR | 2012 0014398 | 2/2012 |
| WO | WO 82/03831 | 11/1982 |
| WO | WO 2005/044659 | 5/2005 |
| WO | WO 2010/123636 | 10/2010 |

OTHER PUBLICATIONS

BIM: "Improving Fuel Efficiency on Fishing Vessels", May 4, 2009 (May 4, 2009), XP055305386, ISBN: 978-1-903412-36-7, Retrieved from the Internet URL:http://www.bim.ie/media/bim/content/publications/Improving Fuel Efficiency on Fishing Vessels (User Friendly Guide).pdf [retrieved on Sep. 26, 2016].

Office Action dated Apr. 24, 2019 issued in Chinese Patent Application No. 201680067365.3.

* cited by examiner

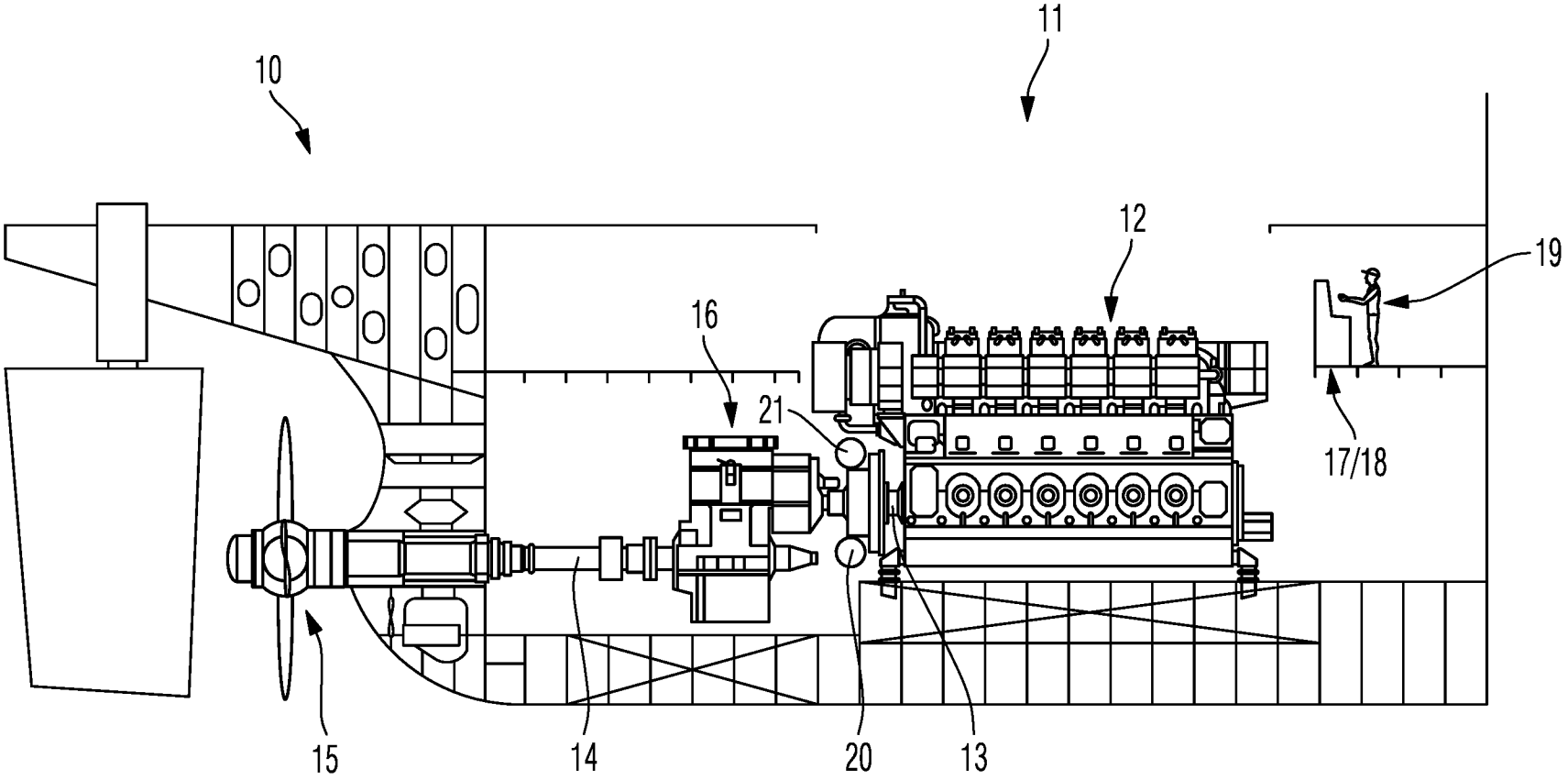
19
17/18
12
11
13
20
21
16
14
15
10

METHOD FOR OPERATING A SHIP PROPULSION SYSTEM AND SHIP PROPULSION SYSTEM

CROSS REFERENCE TO RELATED APPLICATION

This is a U.S. national stage of application No. PCT/EP2016/065250, filed on Jun. 30, 2016. Priority is claimed on German Application No. DE102015014857.5, filed Nov. 17, 2015, the content of which is incorporated here by reference.

BACKGROUND OF THE INVENTION

1. Field of the Invention

The invention relates to methods for operating a ship propulsion system and to a ship propulsion system.

2. Description of the Prior Art

A ship's propulsion system comprises at least a ship's engine, optionally a transmission, a propeller shaft, and a propeller. The transmission is connected between the ship's engine and the propeller shaft or the propeller coupled to the propeller shaft such that the transmission converts a rotational speed and a torque of an engine shaft of the ship's engine into a rotational speed and a torque of the propeller shaft. It is already known that the propeller of a ship propulsion system can be designed as an adjustable propeller, which can be adjusted for a pitch angle of the adjustable propeller. The objective of the ship propulsion system is to generate a drive power that corresponds to a desired speed of the ship set by the operator.

For operating a ship propulsion system it is known, in principle, dependent on a propulsion request to the ship propulsion system on the operator side to determine on the control side and automatically, based on an adjustable propeller characteristic diagram, a setpoint rotational speed for the propeller shaft and a setpoint pitch angle for the adjustable propeller. Dependent on the propulsion request on the operator side and dependent on the setpoint rotational speed for the propeller shaft, a setpoint operating point for the ship's engine is determined, furthermore, on the control side on the basis of a ship's engine characteristic diagram, namely a setpoint rotational speed and a setpoint torque, which the ship's engine has to generate for fulfilling the propulsion request on the operator side taking into account the setpoint rotational speed for the propeller shaft.

SUMMARY OF THE INVENTION

With the above procedure known from practice for operating a ship propulsion system, a propulsion request on the operator side can be automatically converted on the control side into corresponding operating parameters for the adjustable propeller and operating parameters for the ship's engine. There is however a need for further reducing the fuel consumption of a ship propulsion system.

One aspect of the present invention is a method for operating a ship propulsion system and a ship propulsion system. According to one aspect of the invention, an actual operating point of the ship's engine is determined dependent on a measured actual rotational speed and a measured actual torque, wherein dependent on the actual operating point of the ship's engine, it is checked on the control side and automatically based on the adjustable propeller characteristic diagram and of the ship's engine characteristic diagram if with drive power staying the same the setpoint rotational speed for the propeller shaft and the setpoint pitch angle of the adjustable propeller can be changed while reducing a fuel consumption of the ship's engine, wherein in particular when this is possible, the setpoint rotational speed for the propeller shaft, the setpoint pitch angle of the adjustable propeller and the setpoint operating point of the ship's engine are adapted.

With the invention it is proposed for the first time to determine an actually forming actual operating point of the ship's engine based on a measured actual rotational speed and a measured actual torque of the ship's engine. Dependent on the actual operating point it is then checked on the control side and automatically, if with the propulsion power staying the same the fuel consumption of the ship's engine can be reduced, namely via an adaptation of the setpoint rotational speed and of the setpoint pitch angle for the adjustable propeller and thus also subject to adapting the setpoint operating point of the ship's engine. By way of this a ship propulsion system can be operated with reduced fuel consumption and accordingly optimised efficiency.

Preferentially, the actual rotational speed of the ship's engine is measured using a rotational speed sensor and/or the actual moment of the ship's engine via a torque sensor. By way of this the actual operating point of the ship's engine can be easily and reliably detected by measurement.

According to an advantageous further development, the ship speed relative to the water flow is measured. Furthermore, dependent on the ship speed, a limit value for the setpoint pitch angle of the adjustable propeller is determined to avoid cavitations of the adjustable propeller. The additional consideration of a measured ship speed allows a particularly advantageous operation of the ship propulsion system while avoiding cavitations of the adjustable propeller.

BRIEF DESCRIPTION OF THE DRAWINGS

Preferred further developments of the invention are obtained from the subclaims and the following description. Exemplary embodiments of the invention are explained in more detail by way of the drawing without being restricted to this. It shows:

The FIGURE is a diagram of a ship propulsion system.

DETAILED DESCRIPTION OF THE PRESENTLY PREFERRED EMBODIMENTS

The invention relates to a method for operating a ship propulsion system and to a ship propulsion system. The FIGURE shows an extract from a ship 10 in a region of a ship propulsion system 11. The ship propulsion system 11 comprises a ship's engine 12, which at an engine shaft 13 provides a rotational speed and a torque, dependent on an operating point of the ship's engine 12. The ship propulsion system 11, furthermore, comprises an adjustable propeller 15 that is coupled to a propeller shaft 14. On the adjustable propeller 15, at least a so-called pitch angle can be adjusted.

Optionally, the ship propulsion system comprises a transmission 16. The transmission 16 is connected between the adjustable propeller 15 and the ship's engine 12, namely between the propeller shaft 14 and the engine shaft 13, wherein the transmission 16 converts rotational speeds of the engine shaft 13 and torques of the engine shaft 13 into rotational speeds and torques of the propeller shaft 14.

The FIGURE also shows, as part of a control device 17 of the ship propulsion system, an operating terminal 18 on which an operator 19 can preset an operator-side propulsion request to the ship propulsion system 11. Dependent on the operator-side propulsion request to the ship propulsion system 11, a setpoint rotational speed for the propeller shaft 14 and a setpoint pitch angle for the adjustable propeller 15 is determined on the control side and automatically by the control device 17 based on an adjustable propeller characteristic diagram stored in the control device 17. Dependent on the operator-side propulsion request and dependent on the setpoint rotational speed of the propeller shaft 14, a setpoint operating point for the ship's engine 12 is determined and also based on the control side and automatically by the control device 17, based on a ship's engine characteristic diagram stored in the same, namely a setpoint rotational speed and a setpoint torque the the ship's engine 12 has to provide at its engine shaft 13 in order to fulfil or provide the propulsion request on the operator side taking into account the operating parameters determined from the adjustable propeller characteristic diagram.

According to one aspect of the present invention, an actual operating point of the ship's engine 12 is determined dependent on a measured actual rotational speed of the ship's engine 12 and dependent on a measured actual torque of the ship's engine 12. To this end, the ship's engine 12, namely the engine shaft 13 of the same, is assigned a rotational speed sensor 20 and a torque sensor 21 to depict by measurement the torque provided by the ship's engine 12 at its engine shaft 13 and the rotational speed provided at its engine shaft 13.

Dependent on the measured actual torque and the measured actual rotational speed the actual operating point of the ship's engine can then be determined, namely an actual power provided by the ship's engine 12.

According to one aspect of the invention it is provided that dependent on the determined actual operating point of the ship's engine 12, it is checked on the control side and automatically by the control device 17 based on the adjustable propeller characteristic diagram stored in the same and based on the ship's engine characteristic diagram likewise stored in the same, if with the propulsion power of the ship propulsion system staying the same the setpoint rotational speed for the propeller shaft 14 and the setpoint pitch angle for the adjustable propeller 15 can be changed while reducing the fuel consumption of the ship's engine 12, in particular in that the rotational speed of the propeller shaft 14 is reduced and the pitch angle of the adjustable propeller 15 is increased. Since a changed setpoint rotational speed for the propeller shaft 14 has repercussions on the operating point of the ship's engine 12, this verification takes place using the ship's engine characteristic diagram and the adjustable propeller characteristic diagram.

In particular when it follows from the above verification that with the propulsion power of the ship propulsion system 11 staying the same a reduction of the fuel consumption of the ship's engine 12 while changing the setpoint rotational speed of the propeller shaft 14 and a changing of the setpoint pitch angle for the adjustable propeller 15 are possible, the setpoint rotational speed of the propeller shaft 14 and the setpoint pitch angle of the adjustable propeller 15 are suitably adapted, namely subject to suitably adapting the operating point of the ship's engine 12 in order to operate the same while reducing its fuel consumption. However should this not be possible, the setpoint rotational speed of the propeller shaft 14, the setpoint pitch angle of the adjustable propeller 15 and the operating point of the ship's engine 12 are not adapted.

According to an advantageous further development of the invention it is provided to measure the relative speed of the ship. Dependent on the speed of the ship, a limit value for the setpoint pitch angle of the adjustable propeller 15 is determined to avoid cavitations of the adjustable propeller 15. The adaptation of the setpoint pitch angle and of the setpoint rotational speed of adjustable propeller 15 and propeller shaft respectively dependent on the determined actual operation point of the ship's engine then takes place taking into account a limit value for the setpoint pitch angle dependent on the ship speed in order to avoid cavitations of the adjustable propeller 15.

With the invention, a ship propulsion system can be optimally operated while reducing the fuel consumption. At least a torque of the ship's engine 12 and a rotational speed of the same are detected by measurement. Preferentially, a ship speed is detected by measurement, furthermore, in order to exclude cavitations on the adjustable propeller 15.

The invention is employed in particular with ship propulsion systems the ship's engine of which is embodied as a common rail diesel internal combustion engine of a ship.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A method for operating a ship propulsion system for a ship, wherein the ship propulsion system includes an engine, a propeller shaft and an adjustable propeller, wherein a rotational speed of an engine shaft of the engine is converted into a rotational speed of the propeller shaft, and wherein the adjustable propeller is adjustable for adjusting a pitch angle of the adjustable propeller, the method comprising:

determining, on a control side, a setpoint rotational speed for the propeller shaft and a setpoint pitch angle for the adjustable propeller based at least in part on an operator-side propulsion request to the ship propulsion system and an adjustable propeller characteristic diagram;

determining, on the control side, a setpoint operating point, comprising a setpoint rotational speed and a setpoint torque for the engine based at least in part on the operator-side propulsion request, the setpoint rotational speed for the propeller shaft, and an engine characteristic diagram;

determining an actual operating point of the engine based at least in part on a measured actual rotational speed and a measured actual torque;

checking, on the control side, with drive power staying unchanged, whether the setpoint rotational speed for the propeller shaft and the setpoint pitch angle for the adjustable propeller can be changed while reducing a fuel consumption of the engine based at least in part on the actual operating point of the engine, the adjustable propeller characteristic diagram, and the engine characteristic diagram;

adapting the setpoint rotational speed for the propeller shaft, the setpoint pitch angle for the adjustable propeller, and the setpoint operating point of the engine based on the checking;

measuring a relative speed of the ship; and determining a limit value for the setpoint pitch angle of the adjustable propeller based at least in part on a speed of the ship to avoid cavitations of the adjustable propeller.

2. The method according to claim 1, wherein an actual rotational speed of the engine is measured via a rotational speed sensor.

3. The method according to claim 1, wherein an actual moment of the engine is measured via a torque sensor.

4. A ship propulsion system, comprising:

an engine having an engine shaft;

a propeller shaft;

an adjustable propeller coupled to the propeller shaft, wherein the adjustable propeller is adjustable for adjusting a pitch angle of the adjustable propeller;

a transmission configured to convert a rotational speed of the engine shaft into a rotational speed of the propeller shaft, connected between the engine and the adjustable propeller; and a control device, configured to determine, on a control side, a setpoint rotational speed for the propeller shaft and a setpoint pitch angle for the adjustable propeller based at least in part on an operator-side propulsion request to the ship propulsion system and an adjustable propeller characteristic diagram;

determine, on the control side, a setpoint operating point, comprising a setpoint rotational speed and a setpoint torque for the engine based at least in part on the operator-side propulsion request, the setpoint rotational speed for the propeller shaft, and an engine characteristic diagram;

determine an actual operating point of the engine based at least in part on a measured actual rotational speed and a measured actual torque;

check, on the control side, with drive power staying unchanged, whether the setpoint rotational speed for the propeller shaft and the setpoint pitch angle for the adjustable propeller can be changed while reducing a fuel consumption of the engine based at least in part on the actual operating point of the engine, the adjustable propeller characteristic diagram, and the engine characteristic diagram;

adapt the setpoint rotational speed for the propeller shaft, the setpoint pitch angle for the adjustable propeller, and the setpoint operating point of the engine based on the check;

determine a relative speed of the ship; and determine a limit value for the setpoint pitch angle of the adjustable propeller based at least in part on a speed of the ship to avoid cavitations of the adjustable propeller.

5. The ship propulsion system according to claim 4, further comprising: a rotational speed sensor configured to measure an actual rotational speed of the engine.

6. The ship propulsion system according to claim 4, further comprising: a torque sensor configured to measure an actual torque of the engine.

* * * * *